US005797454A

United States Patent [19]

Hipp

[11] Patent Number: 5,797,454

[45] **Date of Patent: *Aug. 25, 1998**

[54] METHOD AND APPARATUS FOR DOWNHOLE FLUID BLAST CLEANING OF OIL WELL CASING

[75] Inventor: James E. Hipp, New Iberia, La.

[73] Assignee: Sonoma Corporation, Lafayette, La.

[ * ] Notice: The term of this patent shall not extend beyond the expiration date of Pat. No. 5,695,009.

[21] Appl. No.: 687,633

[22] Filed: Jul. 26, 1996

Related U.S. Application Data

[63] Continuation-in-part of Ser. No. 550,866, Oct. 31, 1995.

[51] Int. Cl.[6] ..... E21B 23/00

[52] U.S. Cl. ..... 166/196; 166/328; 166/389

[58] Field of Search ..... 166/196, 328, 166/389, 237, 238, 239, 386, 120, 141, 155

[56] References Cited

U.S. PATENT DOCUMENTS

| | | | |
|---|---|---|---|
| 3,570,603 | 3/1971 | Kammerer, Jr. et al. | 166/290 |
| 3,809,162 | 5/1974 | Sydor | 166/315 |
| 3,997,006 | 12/1976 | Wetzel | 166/315 |
| 4,515,218 | 5/1985 | Bissonnette | 166/328 |
| 4,671,361 | 6/1987 | Bolin | 166/377 |
| 5,165,474 | 11/1992 | Buisine et al. | 166/242 |
| 5,404,945 | 4/1995 | Head et al. | 166/155 |
| 5,419,399 | 5/1995 | Smith | 166/377 |

*Primary Examiner*—Frank Tsay
*Attorney, Agent, or Firm*—Pravel, Hewitt, Kimball & Krieger

[57] ABSTRACT

A downhole oil well pulling and running tool provides a releasable tool body that can be used to release a workstring such as a coiled tubing string from a tool assembly and to reattach if desired. To reestablish circulations (the ability to pump fluid down the workstring and up the annulus of the well) after detachment by increasing the pressure across a seated ball to a predetermined pressure that forces the ball through the seat into a ball cage. The cage is sized and shaped to carry a plurality of the ball valving members so that the unlatching and relatching procedure may be repeated as many times as desired until the ball cage is filled. Also providing a delay or timing system that will allow debris to pass thru the tool without a release.

30 Claims, 10 Drawing Sheets

METHOD AND APPARATUS FOR DOWNHOLE FLUID BLAST CLEANING OF OIL WELL CASING

SPECIFICATION

CROSS REFERENCE TO RELATED APPLICATIONS

This is a continuation-in-part of copending U.S. patent application Ser. No. 08/550,866, filed Oct. 31, 1995, which is incorporated herein by reference.

BACKGROUND OF THE INVENTION

1. Field of the Invention

The present invention relates to downhole oil well drilling and production tools and more particularly relates to an improved downhole fluid blasting tool that can be conveyed into a well bore on continuous coil tubing or on threaded pipe, wherein the user has the option of detaching from a carried tool assembly if that assembly becomes stuck and/or plugged in the well bore (e.g. by sand or debris). The improved fluid blasting mechanism is, more particularly, operable by pumping a deformable (for example polymeric) ball valving member through the coil tubing bore or through the work string bore until it seats on a piston. The piston is held in an uppermost position by a return spring. Pressure is applied from the surface via the work string or coil tubing until a pressure differential is reached across the piston which in turn shifts the piston so that is can travel to a lower position, exposing jetting ports that can clean and blast the adjacent casing.

2. General Background

When remedial work is performed on oil and gas wells, and on occasion during the drilling of said wells, certain downhole tool assemblies are conveyed into the well bore on continuous coiled tubing or on a string of connected joints of threaded pipe.

It often becomes desirable to have the option to detach from these tool assemblies. The tool assembly can become stuck and/or plugged in the hole by sand or debris for example.

There are several known downhole tool assemblies which are operated by pumping a steel ball down the workstring. The ball valving member arrives at a releasing device and seats in a piston. Pressure is then applied from the surface through the workstring until a pressure differential is reached across the piston which in turn shears a set of pins or set screws. This movement releases dogs on a collet lock allowing the device to part, leaving the stuck assembly in the hole to be fished out.

Some of the presently available releasing devices allow restricted circulation of fluid through the tool after release. None of the available or prior art devices are relatchable nor can they be released more than one time.

Some patents have issued that disclose devices for releasably connecting one part of the tools string to another. An example is the Smith U.S. Pat. No. 5,419,399 entitled "HYDRAULIC DISCONNECT". In the '399 patent, there is described an improved method and apparatus for releasably connecting one part of a tool string to another, comprising a tubular housing having an uphole and a downhole end, a piston slidably disposed within the tubular housing for longitudinal movement therein between a first position and a second downstream position, the piston having a sealable bore formed therethrough for passage of a pressurized fluid, first connectors for releasably maintaining the piston in the first position thereof prior to sealing of the bore in the piston, a tubular bottom sub having an uphole end for concentric connection to the downhole end of the tubular housing, and a downhole end adapted for connection to a tool string and second connectors for releasably connecting the tubular housing to the bottom sub to normally prevent axial separation therebetween, wherein the piston, upon sealing of the bore to block the passage of the pressurized fluid therethrough and in response to the pressure of the fluid then acting on the piston, is movable from its first to its second position to allow release of the second connectors, whereupon the tubular housing and the bottom sub become separable.

U.S. Pat. No. 5,404,945 discloses a device for controlling fluid flow in oil well casings or drill pipes. The device defines a flow path for fluid through a casing section or drill pipe with the flow path including a throttling valve which restricts or prevents the flow of fluid therethrough. This can be used to prevent U-tubing in casings or can be used to locate leaks in drill pipes or can be used to monitor the position of successive fluids of differing viscosities in a casing string.

An anti-rotation device for cementing plugs with deformable peripheral fins or lips is disclosed in U.S. Pat. No. 5,165,474.

A method and apparatus for hydraulic releasing for a gravel screen is disclosed in U.S. Pat. No. 4,671,361. The '361 patents relates to a tool for use in gravel packing wells, and more particularly to a tool for retention and release of a gravel pack screen assembly when gravel packing wells. The method and apparatus is especially suitable for hydraulic releasing from a screen on a circulation type gravel pack job. The releasing tool comprises a tubular case by which the tool is secured to a gravel pack thereabove and a gravel screen secured thereto below. The case disposed within the collet sleeve assembly show room on top of the case and includes a plurality of collets extending downwardly into the case, the collets being radially outwardly biased into engagement with the case by the lowered end of a releasing mandrel disposed within the collet sleeve. A ball seat on the top of an axial bore extending through the releasing mandrel permits the seating of a ball and downward movement of the releasing mandrel inside the collet sleeve. Removal of the outward bias against the collets and permitting withdrawal of the collet sleeve and releasing mandrel from the case and attached screen therebelow.

The Bissonnette U.S. Pat. No. 4,515,218 discloses casing hardware such as float collars and shoes used in oil well cementing operations. Some of the collars and shoes and constructed of a steel casing with a concrete core inside the casing. The casing structure of the collars and shoes places the core under a predominantly shearing force, so that it will fail at relatively low downhole differential pressures. The invention provides a design for the casing structure which places the concrete core under a predominantly compressive force and greatly increases the amount of pressure the core can withstand without failing.

The Wetzel U.S. Pat. No. 3,997,006 discloses a well tool having a hydraulicly releasable coupler component, a gravel packing apparatus and method for use therewith and a subterranean well having production tubing inserted therein, wherein the coupler comprises hydraulic means for releasing the tubing from the gravel pack apparatus, without rotating said tubing when the coupler is activated and the tubing removed, the lower portion of the coupler remaining in the well with the gravel pack and providing a receptacle for a packing element partially inserted therethrough.

An oversize subsurface tubing pump installation and method of retrieving the pump is disclosed in U.S. Pat. No. 3,809,162. Both the pump barrel and plunger are too large to pass through the tubing. When the pump is to be retrieved, the sucker rods are raised and lift the seating assembly to expose a drain hole in the seating nipple. Fluid drains from the tubing through the exposed drain hole. Continued raising of the sucker rods breaks the connection between the sucker rods and the pump plunger. The sucker rods and then the tubing and pump are pulled from the well. Draining the tube prevents spillage at the top of the well.

A method and apparatus for cementing casing sections and well bores is disclosed in U.S. Pat. No. 3,570,603. Casing sections are cemented in a well bore between producing zones and an upward sequence starting from the bottom. Each casing section is lowered on a running string and running tool to its sitting position, the casing section then being rotated to expand cutter supporting members carried by the casing outwardly to cut a formation shoulder for supporting the cutter members and casing. The running tool is released from the casing and lowered therewith to the casing float shoe, cement being pumped through the running string, tool and shoe to cement the casing in place, running string and tool being removed from the hole.

SUMMARY OF THE INVENTION

The present invention provides a downhole oil well tool apparatus that can include an inside fishing neck on the main body of the device. One of the tools designed to latch with the fishing neck is for example a pulling tool, such pulling tool devices as have been commercially available for years. The present invention provides a bias that allows piston movement in a releasing device in place of shear pins or shear screws. Another apparatus provides a jetting tool that is used to clean the wall of adjacent casing.

A composite ball allows more than one pressure setting to actuate the locking and unlocking piston.

The apparatus of the present invention provides the capability to unlatch and relatch numerous times, using the composite ball by moving the ball through a seat, deforming the ball with pressure.

The present invention allows full circulation of fluid after actuation by forcing the deformable ball valving member through the seat.

The apparatus of the present invention includes a cage portion that catches each of the deformable ball valving member in a cage to prevent those deformable ball valving members from freely moving into the well bore and further restricting flow.

The apparatus of the present invention includes multiple serrated dogs to transfer torque between the two main body parts of the apparatus to permit those two major components to remate with ease.

In one embodiment of the apparatus of the present invention, a jetting device is provided for fluid blast cleaning of a section of well production tubing in an oil and gas well. The alternate embodiment uses an elongated work string that can transmit fluid under pressure down into the well.

The alternate embodiment includes a tool body having upper and lower end portions, a generally cylindrically shaped wall, an exterior surface and a central longitudinal flow bore.

A connector at the upper end of the tool body enables the tool body to be connected to the work string.

A piston mounted in the tool body bore is movable between upper and lower positions. An upper end portion of the piston provides a valve seat. The piston also has a piston bore that communicates with the tool body bore and with the valve seat.

A spring normally urges the piston into the upper position.

One or more jetting orifices extend radially through the tool body wall, the orifices each being in fluid communication with the tool body bore and with the tool body exterior surface. The orifices are positioned to direct pressurized fluid in the direction of the production tubing to be cleaned and fluid blasted.

A ball valving member can be placed into the tool body bore at the seat of the piston by transmitting the ball valving member to the tool body and seat via the work string. The ball valving member has a diameter that is larger than the piston bore diameter at the seat so that the ball can form a seal with the seat when the ball valving member is pumped under pressure to the piston.

The ball valving member and piston are each movable together between upper and lower positions after the ball valving member seats upon the top of the piston.

The jets are normally closed when the piston is in the upper position. When the ball is dropped from the surface for example and flows via the work string to the piston it seats on the top of the piston at the seat. The user then pressures up above the ball to create a pressure differential that shifts the piston and ball from the upper to the lower position. This shifts the ball valving member and seat to a position below the jetting orifices so that pressurized fluid can travel from the tool body bore through the jetting orifices and be used to direct pressurized fluid to clean and fluid blast the production tubing.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
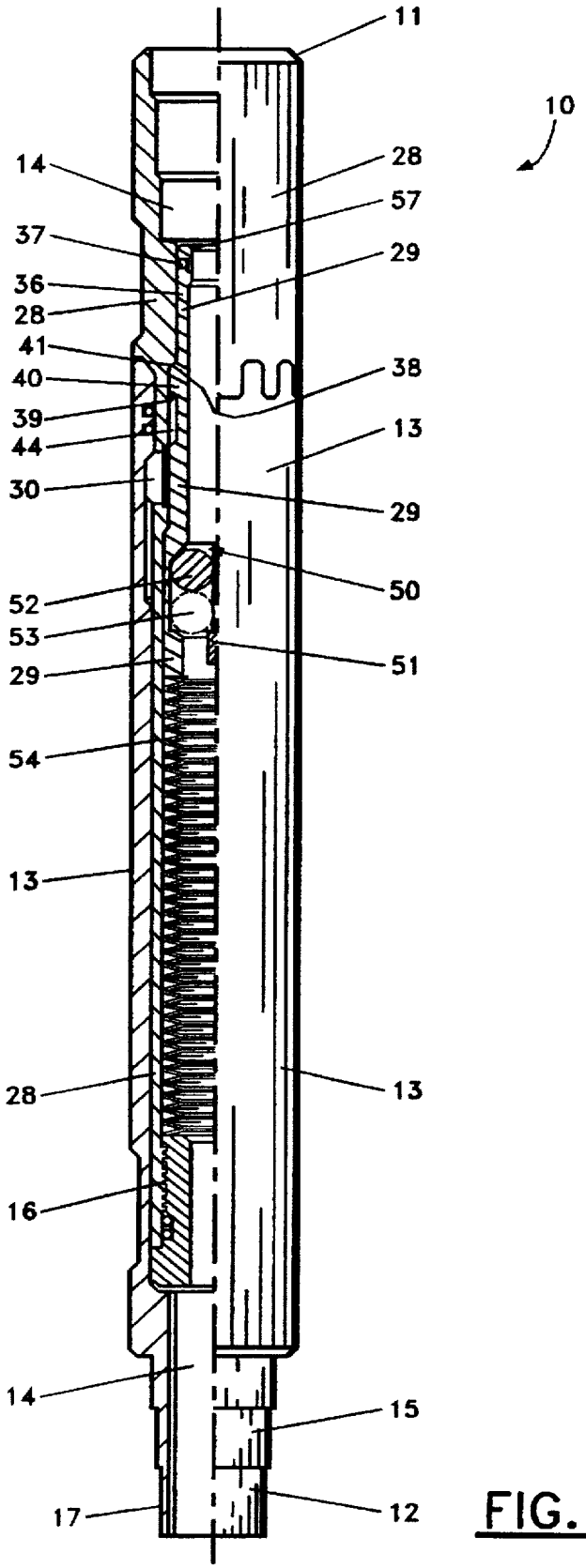
FIG. 1 is a sectional elevational, partially cut-away view of the preferred embodiment of the apparatus of the present invention.
Figure 2:
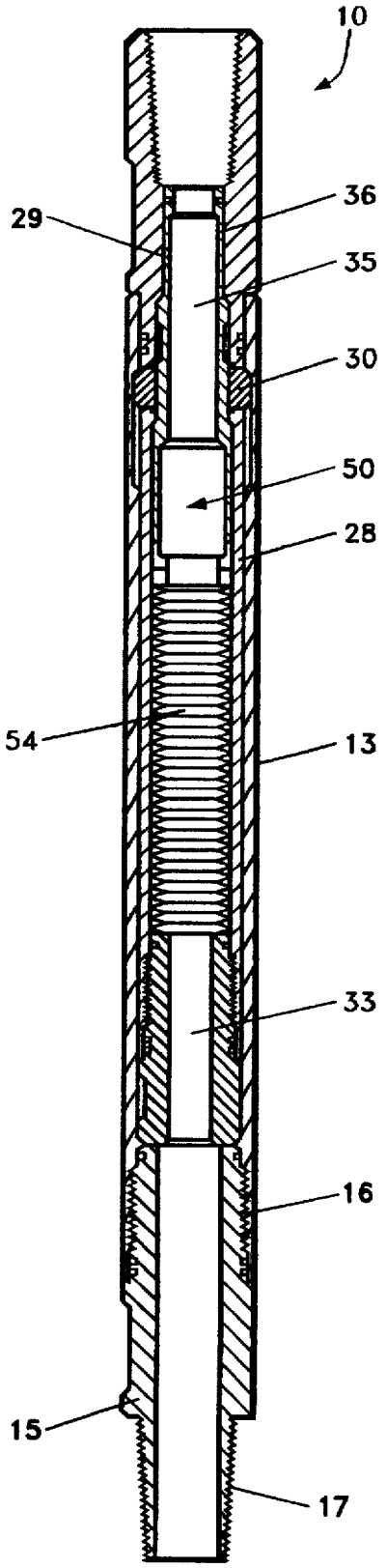
FIG. 2 is a sectional view illustrating the preferred embodiment of the apparatus of the present invention, showing the tool in locked position.
Figure 3:
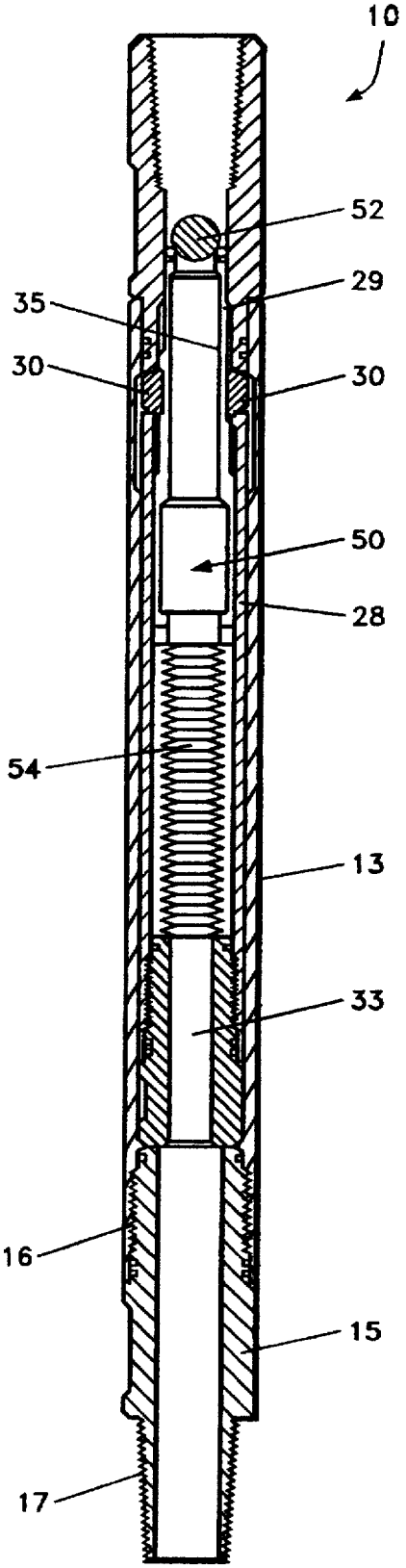
FIG. 3 is a sectional view of the preferred embodiment of the apparatus of the present invention illustrating the tool in a pressured up position.

FIGS. 1–3 show generally the preferred embodiment of the apparatus of the present invention designated by the numeral 10. Pulling and releasing tool 10 has an upper end portion 11 and a lower end portion 12 when the tool is assembled and oriented in operating position for running in a well. A flow bore 14 allows circulation through the tool 10 between end portions 11, 12.

The apparatus 10 includes a main body portion 13 having an inner open ended bore 18. At the lower end portion of the main body 13 that is provided a threaded sub member 15. The sub member 15 forms a connection to main body 13 at threaded connection 16. The sub 15 provides lower external threads 17 for attaching main body 13 to other tools, tool sections, pipe or the like.

Figure 4:
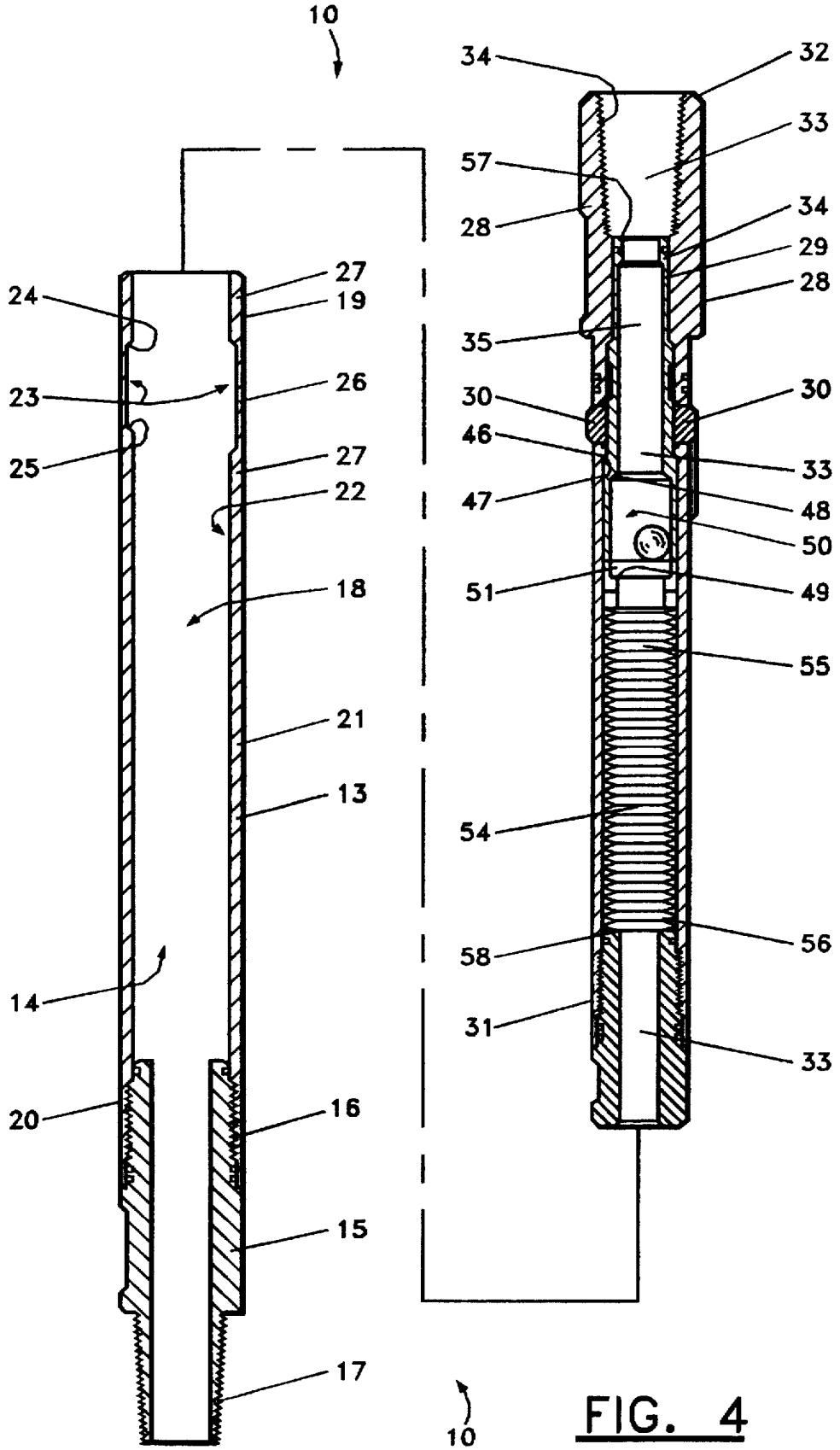
FIG. 4 is a sectional view of the preferred embodiment of the apparatus of the present invention showing the mandrel removed, the ball valving member having been pumped through to the ball cage to allow circulation.

The main body 13 (FIG. 4) has an upper end portion 19, and a lower end 20. Open ended bore 18 receives an inner mandrel 28. The main body 13 includes a generally tubular cylindrically shaped main body wall 21 with an inside surface 22. A pair of spaced apart beveled annular shoulders 24, 25 define therebetween an annular recess 23. The side wall of the main body 13 has a thin side wall 26 at the annular recess 23. On the sides of the annular recess 23, there are provided thick side wall portions 27 as shown in FIG. 4.

The main body 13 receives an inner mandrel 28, a fluid pressure operated piston 29 and locking dogs 30 that are used to engage the inner mandrel 28 and main body 13. In FIG. 4, mandrel 28 has an upper end 32 and a lower end 31. Inner mandrel 28 has a bore 33 that extends completely through inner mandrel 28. Piston 29 occupies a portion of bore 33 as shown in FIG. 4. The inner mandrel 28 provides an internally threaded connection portion 34 for attachment to a coiled tubing string, work string or the like during use. Threaded connection portion 34 enables a user to raise and lower the tool 10 in an oil/gas well using a coil tubing unit for example.

The piston 29 is hollow, providing a piston bore 35. The piston 29 has an upper end 36 defining a ball valve seat 57. O-ring 37 forms a seal with inner mandrel 28. Annular ring 40 limits travel of piston 29 in an upward direction. In FIG. 1, annular ring 40 is in an uppermost position. Beveled annular surfaces 38, 39 are provided on each side of annular ring 40.

Stop 46 is provided on inner mandrel 28 in the form of a beveled annular shoulder. Annular shoulders 39 and 42 define therebetween a reduced diameter annular recess 44. Piston 29 is of a reduced diameter at 43. A thickened section 45 is provided between annular recess 44 and ball cage 50. Stop 46 limits the travel of piston 29 within the bore of main body 13. Annular shoulder 47 and beveled annular surfaces 48, 49 define ball cage 50.

Ball cage 50 is in an expanded area for receiving ball valving members 52, 53 that are pumped through when inner mandrel 28 is to be released from main body 13. When a ball valving member 52, 53 is pumped from seat 57 to cage 50, it deforms because it must pass through a reduced diameter section of piston bore 35. A cross bar 51 holds the ball valving members 52, 53 within the ball cage 50 after each ball valving member 52, 53 has been pumped therethrough. Otherwise, fluid can flow through cage 50 to the lower end of bore 33. The ball cage 50 is preferably sized to hold as many as six ball valving members (such as 52, 53) after they have been pumped through. Spring 54 biases the piston 29 in an uppermost position as shown in FIG. 1. The spring 54 has an upper end 55 and a lower end 56. Upper end 55 engages the lower end of piston 29. Lower end 56 of spring 54 engages spring stop 58 as shown in FIG. 4.

During use, the apparatus 10 is lowered into the well bore on a work string such as a coil tubing string. The apparatus 10 assumes the position of FIG. 1 when being lowered to the well bore. In this initial position, spring 54 biases the piston 29 in the upper position shown in FIG. 1.

The spring 54 bottoms on stop 58 and engages the lower end of piston 29. Stop 58 threadably attaches at connection 59 to inner mandrel 28. The piston 29 upper end provides annular ball valving seat 57 that is receptive of a ball valving member 52 or 53.

If the tool 10 becomes stuck, it is desirable to release the inner mandrel 28 portion of the apparatus 10 from the main body 13. In such a case, the user pumps a ball valving member 52 into the well bore via a coil tubing unit which has an internal flow bore. When the ball valving member 52 reaches the ball seat 57 and registers upon seat 57, the ball valving member 52 forms a closure with seat 57.

This closure prevents the flow of fluids from the coil tubing unit bore into the tool body bore 14. The user then pressures up the coil tubing unit which increases pressure on ball valving member 52, 53. The use of a coil tubing unit to "pressure up" above a ball valving member is known in the art.

With the present invention, a deformable ball valving member is selected, such as a ball valving member of a plastic material. There are two basic operating pressures, a first pressure shifts tool (piston), a second pressure forces the ball 52 or 53 thru seat 57. This allows pressure to be increased to a predetermined value (first pressure) overcoming the force of bias spring 54, moving piston 29 down and releasing dogs 30. The ball valving member 52 deforms and passes through the ball seat 57 downwardly via the bore 53 and into the ball cage 50. This takes place at the second predetermined pressure value number two. The ball valving member 52 is of a deformable material such as a plastic polymeric material, Teflon® or nylon being preferred.

Once the ball valving member 52 or 53 is pumped from the seat 57 into the ball cage 50 via piston bore 35, the user can circulate fluids into the well. Circulation is possible because the ball valving member 52 no longer forms a closure at the ball seat 57. The ball cage 50 is large enough to hold more than one ball valving members 52, 53. Cross bar 51 prevents further downward movement of ball 52 or 53 once the ball 52, 53 reaches cage 50. Fluid circulation is allowed because the cage 50 is larger in cross section than a plurality of the ball valving members 52, 53.

One of the features of the apparatus 10 of the present invention is the ability to reinstall the mandrel 28 after it has been released. After mandrel 28 is removed from main body 13, and ball 52 has been forced through piston 29 spring 54 forces piston 29 up to the position of FIG. 4. In order to reattach, piston 29 must be moved down to the position shown in FIG. 5 so that the dogs 30 and recess 44 are adjacent. In this position, the mandrel 28 and dogs 30 have an overall diameter that will fit inside bore 18 of main body 13. A reattachment is accomplished by dropping a second ball valving member 53 via the coil tubing string to the seat 57.

Figure 5:
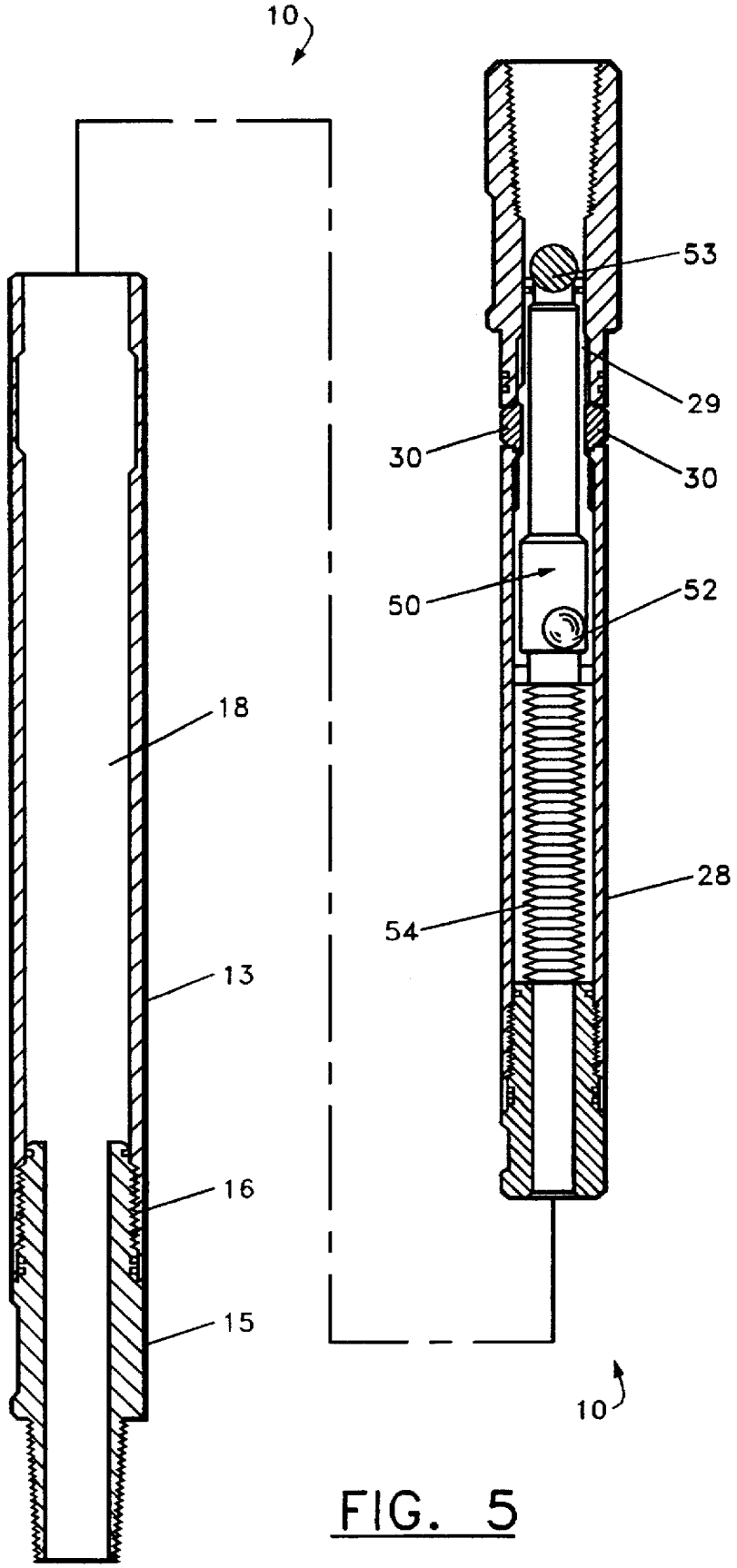
FIG. 5 is a sectional view of the preferred embodiment of the apparatus of the present invention illustrating the placement of a second ball valving member used to unlock the tool for mandrel reinstallation.
Figure 6:
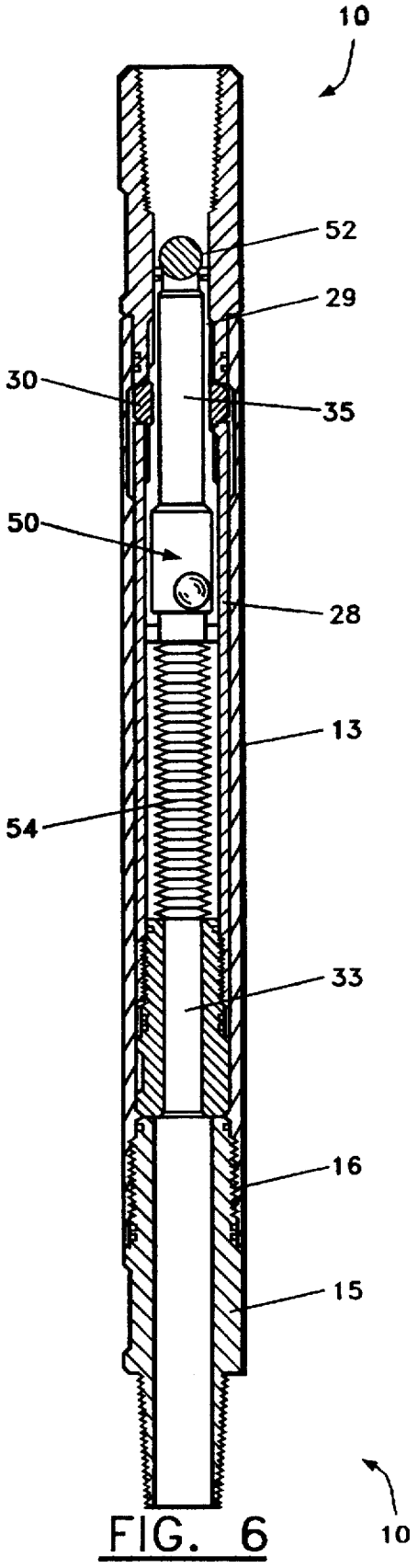
FIG. 6 is a sectional view of the preferred embodiment of the apparatus of the present invention illustrating the mandrel having been reinstalled.
Figure 7:
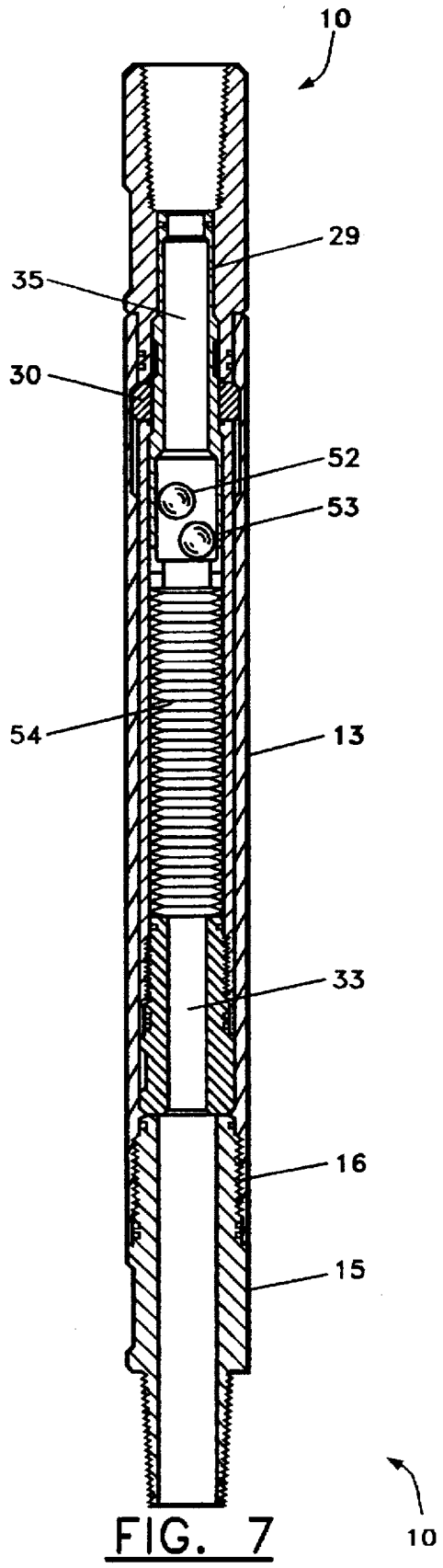
FIG. 7 is a sectional view of the preferred embodiment of the apparatus of the present invention showing the second ball having been pumped through to the ball case to relatch and resume operations.

Once the second ball valving member 53 is in a sealing position on seat 57 (see FIGS. 5–6). The device 10 is pressured to the first pressure value allowing dogs 30 to move inward as in FIG. 5. Mandrel 28 can now be lowered into main body 13 as overall diameter is reduced. The mandrel 28 and its piston 29 can be reconnected to bore 18 of main body 13 as shown in FIG. 6.

Figures 8A, 8B:
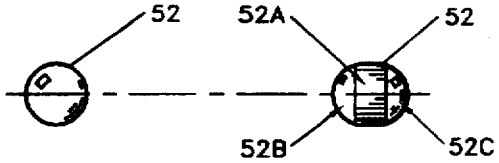
FIGS. 8A–8B are side views of the deformable ball valving member showing its configuration before (FIG. 8A) and after (FIG. 8B) it is pumped through to the ball cage.

A smaller overall diameter of dogs 30 is achieved by pressuring up the bore 33 above ball valving member 53 to the first preselected pressure value. This forces piston 29 downwardly to the position shown in FIG. 5 and 6. The mandrel 28 can now fit bore 18 of main body 13. To interlock mandrel 28 and body 13, ball valving member 53 is pumped through to cage 50 at the second preselected pressure value. Spring 54 then returns piston 29 and dogs 30 to locked or connected position. This attachment and disattachment can be repeated over and over if desired until cage 50 is filled with ball valving members. In FIG. 8A, a spherical ball valving member 52 is shown before being pumped through to bull cage 50. In FIG. 8B, a deformed ball valving member 52 is shown having a cylindrical outer surface portion 52A and a pair of opposed hemispherical outer surface portions 52B, 52C.

Figure 9:
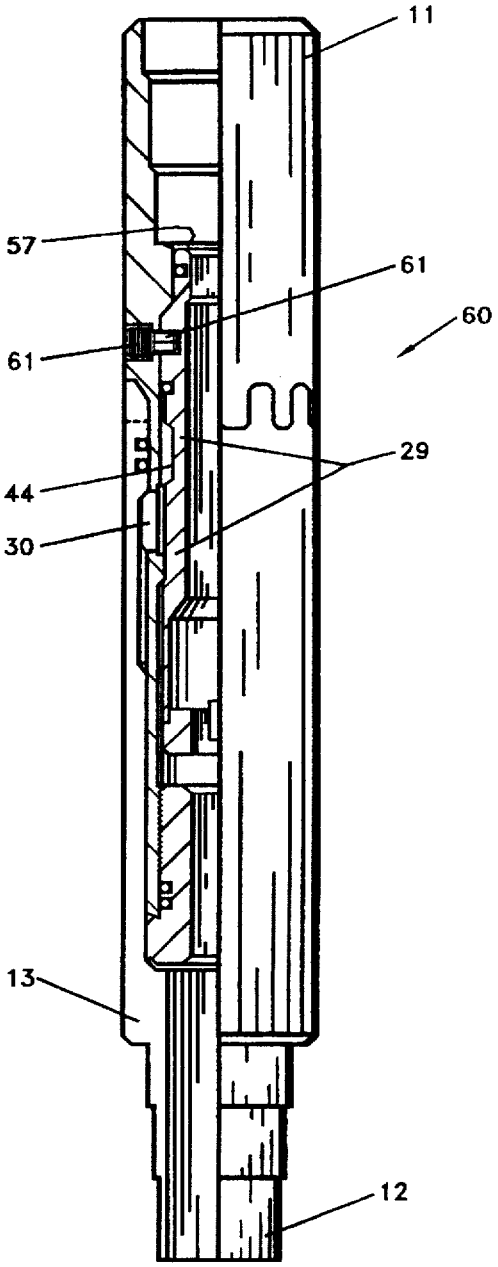
FIG. 9 is an elevational sectional view of an alternate embodiment of the apparatus of the present invention.

FIG. 9 shows an alternate embodiment of the apparatus of the present invention by the numeral 60. The tool 60 is constructed as the tool 10 of the preferred embodiment, but for the elimination spring 54.

Tool 60 has a shear pin 61 in the embodiment of FIG. 9. The tool 60 is a construction that is not designed to be reset. When a ball valving member 52 or 53 is dropped from the wellhead and travels via coil tubing unit bore to seat 57, the piston 29 can be shifted downwardly by pressuring up within the coil tubing bore. This pressuring up shears pin 61 allowing piston 29 to travel downwardly until recess 44 aligns with dogs 30 as with the preferred embodiment tool 10. However, no spring 54 is provided, so that resetting is not possible. Full circulation is however provided.

Figure 10:
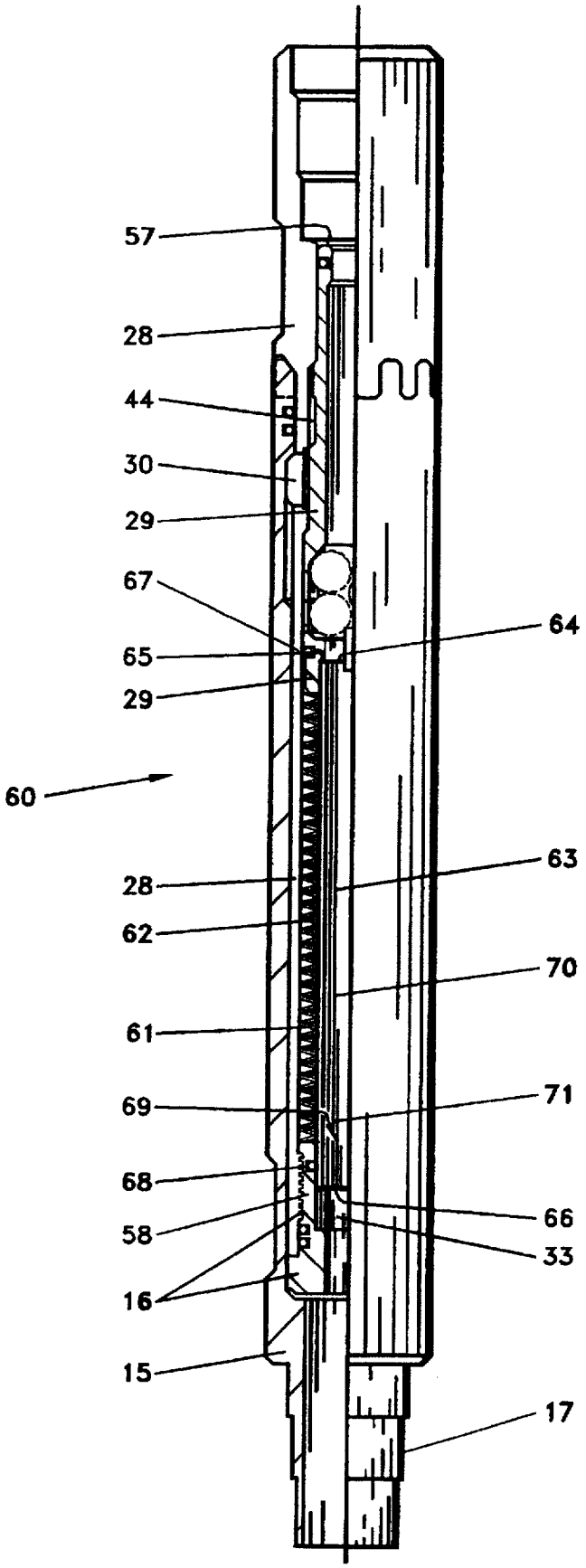
FIG. 10 is an elevational sectional view of a second alternate embodiment of the apparatus of the present invention.

FIG. 10 shows a second alternate embodiment of the apparatus of the present invention designated by generally by the numeral 60. Pulling and releasing tool 60 provides an embodiment that solves an inherent problem of ball operated tools that are shear pin operated. One of the inherent problems ball operated tools that use shear pins is that they are prone to shear and release when debris is accidentally picked up by circulating pumps and conveyed downhole into the well bore. Before this debris can be blown through to a safety zone using extra pressure, sufficient differential pressure is often created to shear the pin or pins causing premature release. The debris will generally blow through the tool after this premature release occurs with the shearing of the pins.

With the embodiment of FIG. 10, a shifting of inner piston 29 is delayed briefly. This delaying of the shifting action of piston 29 allows any debris that lodges in seat 29 sufficient time to clear the seat before shifting can occur. The alternate embodiment of FIG. 10 provides an improvement to prior art type ball operated tools of the type that have a shear pin holding arrangement. A delayed shifting of the inner piston of a ball operated tool is not possible with a shear pin held device, but is feasible with a spring loaded device such as is shown in FIG. 10 and described hereinafter.

In FIG. 10, tool 60 includes the same main body 13 as with the embodiment of FIGS. 1–8. The embodiment of FIG. 10 has a mandrel 28 that is sized and shaped similarly to the mandrel 28 of FIGS. 1–8. Likewise, the embodiment of FIG. 10 provides a piston 29 that is slidably movable within the bore of mandrel 28 as with the embodiment of FIGS. 1–8.

In FIG. 10, piston 29 also includes the same annular recess 44 and the same locking dogs 30 as the embodiment of FIGS. 1–8. The tool 60 is operated by dropping a ball from the surface and allowing that ball to flow via a coil tubing unit to seat 57 as occurs in the embodiment of FIGS. 1–8. However, the embodiment of FIG. 10 includes a timer or clock arrangement that delays operation of the releasing mechanism.

This clock capability is in the form of a chamber 61 that holds coil spring 62 and cylindrical tube 63. The tube 63 has an upper end 64 that fits an annular shoulder 65 at the bottom of piston 29 and is sealed by welding. The lower end 66 of tube 63 fits the bore 33 of spring stop 58. Seals are provided at 67, 68. The lower end 66 of cylindrical tubes 63 provides a small orifice 69. The area between mandrel 28 and cylindrical tube 63 forms a chamber 61 that carries spring 28. Chamber 70 is sealed at the top with seal 67 and at the bottom with seal 68. Therefore, in order to move the piston 29 downwardly so that the locking dogs 30 can register in the annular recess 44, the tube 63 must also move down with the piston 29.

Downward movement of the piston 29 and tube 63 is slowed because fluid contained within chamber 61 must flow through orifice 69 into the center bore 70 of tube 63 as shown by arrow 71. This arrangement produces a delay device or "clock" slowing the cycle time of the release sufficiently to allow most of any debris to clear the device without activation. The spring 28 will return the apparatus to is initial position shown in FIG. 10 if in fact debris has been the cause of a restriction at seat 57. The debris should clear the seat before release takes place so that the spring then returns piston 29 to the position shown in FIG. 10.

Figure 11:
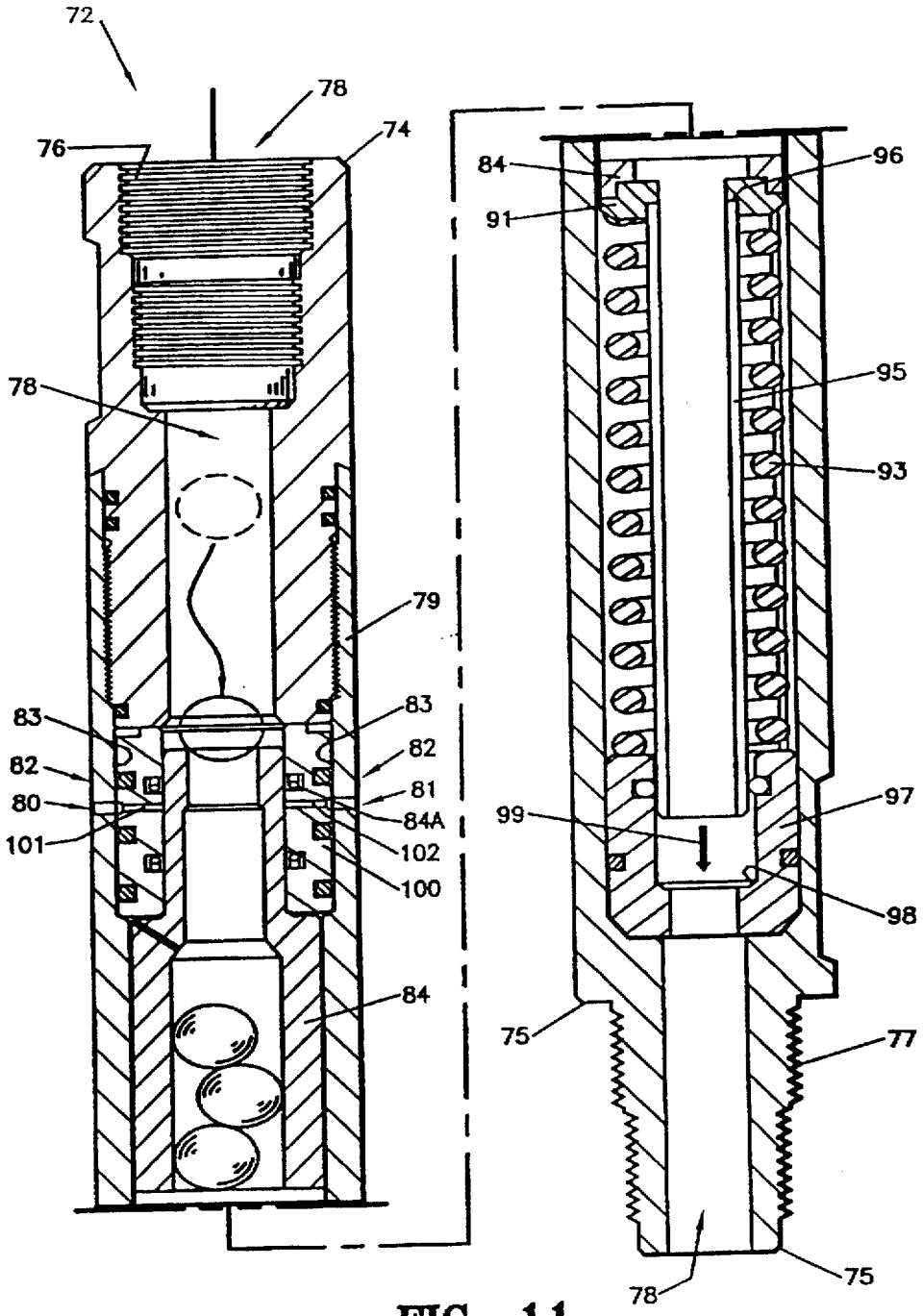
FIGS. 11–13 are sectional, elevational views of the alternate embodiment of the apparatus of the present invention showing a fluid blasting tool.

FIG. 11 shows an alternate embodiment of the apparatus of the present invention designated generally by the numeral 72. Fluid blasting tool 72 has a tool body 73 with an upper end 74 and lower end 75. The upper end 74 has internal threads 76 for forming a connection with a work string. The lower end 75 has external threads 77 so that a connection can be formed with a drill for example. Tool body 73 has an elongated open ended bore 78 that communicates with upper end 74 and lower end 75 of tool body 73. The tool body 73 provides a cylindrical wall 79 with a plurality of jetting orifices 80, 81 extending through the tool body wall 79, each orifice 80, 81 communicating with wall outer surface 82 and wall inner surface 83.

Figure 12:
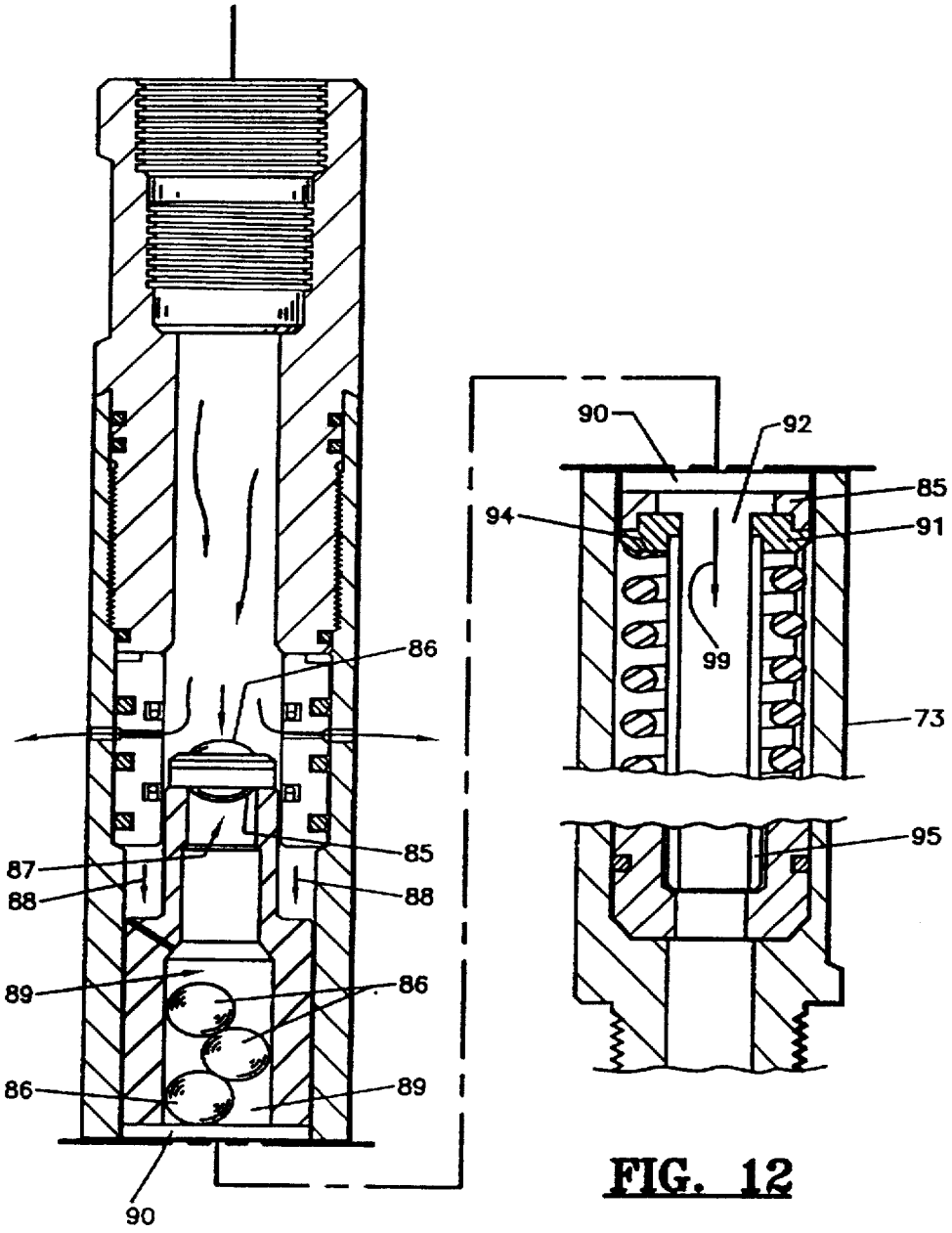

Piston 84 is movable between an upper position (as shown in FIG. 11) and a lower position (as shown in FIG. 12) that is defined by the travel of piston 84 and sleeve 95 downwardly in the direction of arrow 99 until the sleeve 95 reaches stop 98.

Piston 84 provides an annular seat 85 that can receive and form a seal with spherical ball valving member 86. The seat 84 can be a beveled annular seat to assist in deformation of the ball 86. The ball valving member 86 is of an external diameter that is larger than the diameter annular seat 85. However, the ball valving member 86 is of a deformable material such as nylon for example so that the ball valving member 86 can deform to fit through piston bore 87 above cage 89.

Piston bore 87 is smaller than the diameter of ball vavling member 86 so that the ball vavling member 86 can only travel through the piston bore 87 by deforming and being forced by pressurized fluid and a pressure differential created above annular seat 85. This pressure differential is created by raising pump pressure in the work string and tool body bore 78 above seat 85. As a ball valving member 86 is deformed and pumped through in the direction of arrows 88, it is deposited in cage 89.

The cage 89 defines an enlarged diameter portion of bore 78 that can hold a plurality of deformed ball valving members 86. A cross bar 90 is provided at the lower end portion of cage 89 for preventing downward travel of ball vavling members 86 beyond stop 90 after they have been pumped through the reduced diameter section of bore 87.

At the lower end of piston 84 there is provided a collar 91 having a central circular opening 92. Coil spring 93 has an upper end engages the flat annular surface 94 of collar 91. A cylindrically shaped tube 95 fits inside coil spring 93 as shown in FIG. 11. The tube 95 has an upper end that engages annular shoulder 96 of collar 91. The lower end of sleeve 97 fits inside of a correspondingly shaped bore of sleeve 97. An annular shoulder in the form of stop 98 defines the lowermost movement of sleeve 95 and therefore of collar 91 and piston 84.

In FIGS. 11–12, arrow 99 indicates the direction of travel of piston 84, collar 91, and sleeve 95 when a ball valving member 86 has been deposited upon annular seat 85 and pressure increased.

An initial predetermined pressure level can be adjusted by spring rate of spring 93 and/or cross sectional area of piston 84 at seal 84A. For example, 1200 psi can be used to move the ball valving member 86 and piston 84 to the lower position in the direction of arrow 99. This lower position is reached when tube 95 hits stop 98. In this position, the upper end of piston 84 travels below jetting orifices 80, 81. Fluidized pressure within bore 78 and above ball 86 and piston 84 can then be transmitted through orifices 80, 81 for blasting of the adjacent production tubing. After this blasting operation is completed, the pressure above ball valving member 86 and piston 84 is elevated to an higher level (e.g. 3500 psi) sufficient to push ball valving member 85 through the narrow diameter section 87 of the piston bore as the ball 86 deforms (see FIG. 13). The higher pressure can be adjustable by varying seat diameter, the angle of the seat determines how quickly ball will deform (e.g. a long angle will deform a ball quicker than a flat edge) and/or ball material. This results in a travel of the deformed ball 86 in the direction of arrows 88 into cage 89. This also opens bore 78 to complete circulation between the end portions 74, 75 of tool body 72.

Figure 13:
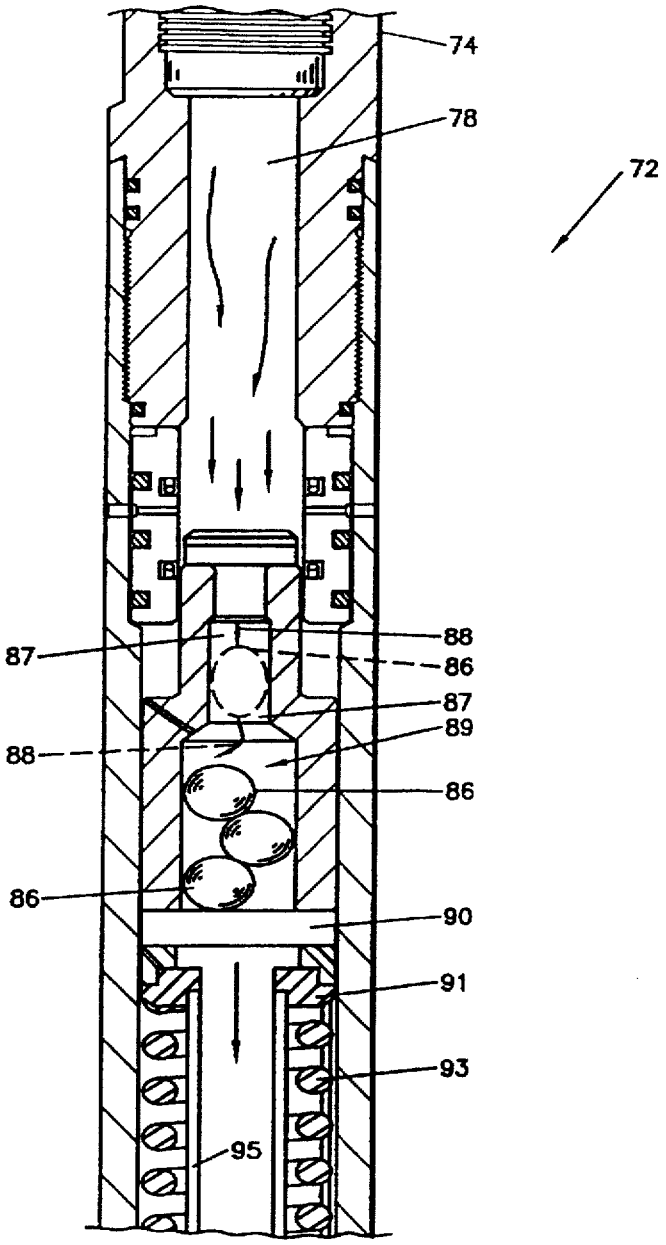

One of the features of the present invention as shown in FIGS. 11–13 is the use of sleeve 100 to regulate the number of jetting orifices 80, 81 that are used during the jetting operation. The sleeve 100 is an annular sleeve that can have any desired number of transverse channels 101–102. In this fashion, the tool body 73 can provide a large number of jetting orifices 80, 81 such as 4, 6, 8, etc. in number. The user then selects a sleeve 100 having as many or as few lateral channels 101, 102 as desired. Thus, for example, if the tool body provides eight circumferentially spaced, radially extending jetting orifices 80, 81, (e.g. sixty degrees apart) a sleeve 100 can be selected that only provides two lateral channels 101, 102 (e.g. 180° apart). Even though the tool body provides eight jetting orifices, only two would be used in the jetting operation if the sleeve 100 provides two lateral channels 101, 102. The sleeve 100 could be a removable component of the apparatus 72 that would be custom selected before operation to give the desired location and number of channels 101, 102 (and thus jetting orifices 80, 81) that are used in a particular job.

The following table lists the parts numbers and parts descriptions as used herein and in the drawings attached hereto.

PARTS LIST

| Part Number | Description |
|---|---|
| 10 | pulling and releasing tool |
| 11 | upper end portion |
| 12 | lower end portion |
| 13 | main body |
| 14 | inner open ended bore |
| 15 | threaded sub |
| 16 | threaded connection |
| 17 | lower external threads |
| 18 | internal bore |
| 19 | upper end |
| 20 | lower end |
| 21 | main body wall |
| 22 | inside surface |
| 23 | annular recess |
| 24 | annular shoulder |
| 25 | annular shoulder |
| 26 | thin side wall |
| 27 | thick side wall |
| 28 | inner mandrel |
| 29 | piston |
| 30 | locking dogs |
| 31 | lower end |
| 32 | upper end |
| 33 | bore |
| 34 | internally threaded portion |
| 35 | piston bore |
| 36 | upper end |
| 37 | o - ring |
| 38 | beveled annular surface |
| 39 | beveled annular surface |
| 40 | annular ring |
| 41 | annular shoulder |
| 42 | beveled annular surface |
| 43 | reduced diameter portion |
| 44 | annular recess |
| 45 | thickened section |
| 46 | stop |
| 47 | annular shoulder |
| 48 | beveled annular surface |
| 49 | beveled annular surface |
| 50 | ball cage |
| 51 | cross bar |
| 52 | ball valving member |
| 52A | cylindrical surface |
| 52B | hemispherical surface |
| 53C | hemispherical surface |
| 53 | ball valving member |
| 54 | spring |
| 55 | upper end |
| 56 | lower end |
| 57 | ball seat |
| 58 | spring stop |
| 59 | threaded connection |
| 60 | pulling and releasing tool |
| 61 | chamber |
| 62 | spring |
| 63 | tube |
| 64 | upper end |
| 65 | annular shoulder |
| 66 | lower end |
| 67 | seal |
| 68 | seal |
| 69 | tube orifice |
| 70 | tube bore |
| 71 | arrow |
| 72 | fluid blasting tool |

PARTS LIST-continued

| Part Number | Description |
|---|---|
| 73 | tool body |
| 74 | upper end |
| 75 | lower end |
| 76 | internal threads |
| 77 | external threads |
| 78 | bore |
| 79 | cylindrical wall |
| 80 | jetting orifice |
| 81 | jetting orifice |
| 82 | wall outer surface |
| 83 | wall inner surface |
| 84 | piston |
| 84A | seal |
| 85 | annular seat |
| 86 | ball |
| 87 | piston bore |
| 88 | arrow |
| 89 | cage |
| 90 | stop bar |
| 91 | collar |
| 92 | opening |
| 93 | coil spring |
| 94 | flat annular surface |
| 95 | tube |
| 96 | annular shoulder |
| 97 | sleeve |
| 98 | stop |
| 99 | arrow |
| 100 | sleeve |
| 101 | channels |
| 102 | channels |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A downhole oil well pulling and running tool comprising:

a) an elongated tool body having an upper end portion with means thereon for forming a connection with a drill string or workstring;

b) the tool body comprising a main body portion that is tubular, having upper and lower end portions, said main body having a bore;

c) an elongated generally tubular piston slidable within the main body bore;

d) piston locking means for locking the piston in a first running position;

e) the piston having a valve seat portion;

f) a deformable ball valving member sized and shaped to register upon the valve seat and that can be transmitted into the tool bore from the well surface area via the workstring for engaging the valve seat;

g) a cage member disposed below the valve seat;

h) a channel that extends between the valve seat and the cage member;

i) means for transporting the ball valving member from the seat to the cage member, wherein the ball valving member is sized to fit the seat forming a seal therewith, and wherein the ball valving member is deformable to conform to the channel during transport to the cage member.

2. The tool apparatus of claim 1 wherein the ball valving member is plastic.

3. The tool apparatus of claim 2 wherein the ball valving member is polymeric.

4. The tool apparatus of claim 1 wherein the tool body has means thereon for forming a connection with a drill or workstring having a flow bore, and wherein the connection enables fluid communication between the workstring bore and main body bore.

5. The tool apparatus of claim 1 wherein the channel has a restricted diameter portion that is smaller than the diameter of the ball valving member.

6. The tool apparatus of claim 1 wherein the piston locking means comprises in part a spring.

7. The tool apparatus of claim 1 wherein the piston locking means includes a shear pin that forms a connection between the main body and piston.

8. The tool apparatus of claim 1 further comprising a spring for biasing the piston towards an upper position.

9. A downhole oil well pulling and running tool comprising:

a) an elongated tool body having an upper end portion with means thereon for forming a connection with a drill string or workstring;

b) the tool body comprising a main body portion that is tubular, having upper and lower end portions, said main body having a bore;

c) an elongated generally tubular piston slidable within the main body bore and having an upper end with a valve seat the piston being movable between running and releasing positions;

d) piston locking means for locking the piston in a first running position;

e) the piston having a valve seat portion;

f) a ball valving member that can be transmitted into the tool bore from via the workstring, the ball valving member forming a seal on the valve seat; and g) a timer for slowing travel of the piston from the running to the releasing position, said timer including a fluid chamber and an orifice, wherein fluid must flow from the chamber through the orifice before the releasing position is reached.

10. The tool apparatus of claim 9 wherein the ball valving member is deformable.

11. The tool apparatus of claim 9 wherein the ball valving member is not deformable.

12. The tool apparatus of claim 9 wherein the tool body has means thereon for forming a connection with a drill or workstring having a flow bore, and wherein the connection enables fluid communication between the flow bore and main body bore.

13. The tool apparatus of claim 9 wherein the orifice is smaller in diameter than the diameter of the valve seat.

14. The tool apparatus of claim 9 wherein the piston locking means comprises in part a spring.

15. The tool apparatus of claim 9 wherein the piston locking means includes a shear pin that forms a connection between the main body and piston.

16. The tool apparatus of claim 9 further comprising a spring for biasing the piston towards an upper position.

17. The tool apparatus of claim 9 further comprising a sleeve disposed beneath the piston, and said piston carries said orifice.

18. The tool apparatus of claim 17 wherein the sleeve is spaced from the tool body, said fluid chamber being in between said sleeve and said tool body.

19. The tool apparatus of claim 18 wherein the sleeve is affixed at its upper end to said piston for travel therewith.

20. The tool apparatus of claim 19 wherein said spring surrounds said sleeve.

21. The tool apparatus of claim 10 wherein the seat is beveled to assist in deformation of the ball.

22. A downhole oil well pulling and running tool comprising:

a) an elongated tool body having an upper end portion with means thereon for forming a connection with a drill string or workstring;

b) the tool body comprising a main body portion that is tubular, having upper and lower end portions, said main body having a bore;

c) an elongated generally tubular piston slidable within the main body bore;

d) piston locking means for locking the piston in a first running position;

e) the piston having a valve seat portion;

f) a deformable ball valving member that is movable between a sealing position wherein the ball valving member registers upon the valve seat and a running position wherein it is removed from said seat;

g) a cage member disposed below the valve seat;

h) a channel that extends between the valve seat and the cage member;

i) means for transporting the ball valving member from the seat to the cage member, wherein the ball valving member is sized to fit the seat forming a seal therewith, and wherein the ball valving member is deformable to conform to the channel during transport to the cage member.

23. The tool apparatus of claim 22 further comprising flow passages through both the drill string or workstring and tool body for transmitting the valving member through the tool body main bore to the valve seat.

24. The tool apparatus of claim 22 wherein the channel has a restricted diameter portion that is smaller than the diameter of the ball valving member.

25. A downhole oil well pulling and running tool comprising:

a) an elongated tool body having an upper end portion with means thereon for forming a connection with a drill string or workstring;

b) the tool body comprising a main body portion that is tubular, having upper and lower end portions, said main body having a bore;

c) an elongated generally tubular piston slidable within the main body bore and having an upper end with a valve seat the piston being movable between running and releasing positions;

d) the piston having a valve seat portion;

e) a valving member movably disposed within the tool body bore during use for sealing the bore at the valve seat; and f) a timer for slowing travel of the piston from the running to the releasing position, said timer including a fluid chamber and an orifice, wherein fluid must flow from the chamber through the orifice before the releasing position is reached.

26. The tool apparatus of claim 25 further comprising flow passages through both the drill string or workstring and tool body for transmitting the valving member through the tool body main bore to the valve seat.

27. A downhole oil well pulling and running tool comprising:

a) an elongated tool body having an upper end portion with means thereon for forming a connection with a drill string or workstring;

b) the tool body comprising a main body portion that is tubular, having upper and lower end portions, said main body having a bore;

c) an elongated generally tubular piston slidable within the main body bore;

d) piston locking means for locking the piston in a first running position;

e) the piston having a valve seat portion;

f) a deformable valving member disposed within the tool body main bore during use that is sized and shaped to form a seal with the valve seat to thereby limit flow through the main body bore at the seat;

g) a cage member disposed below the valve seat;

h) a channel that extends between the valve seat and the cage member; and i) wherein the valving member is deformable to conform to the channel during transport through the channel to the cage member.

28. The tool apparatus of claim 27 further comprising flow passages through both the drill string or workstring and tool body for transmitting the valving member through the tool body main bore to the valve seat.

29. The tool apparatus of claim 27 wherein the valving member is of a polymeric material.

30. The tool apparatus of claim 27 further comprising a spring for biasing the piston towards an upper position.

* * * * *